US006416000B1

(12) United States Patent
Lusty et al.

(10) Patent No.: US 6,416,000 B1
(45) Date of Patent: Jul. 9, 2002

(54) ROTOR FLOW MATCHING TO MINERAL BREAKING CHAMBER

(75) Inventors: Andrew William Kevin Lusty, Matamata; Alan Mark Garvin, Cambridge, both of (NZ)

(73) Assignee: Svedala Barmac Limited, Matamata (NZ)

( * ) Notice: Subject to any disclaimer, the term of this patent is extended or adjusted under 35 U.S.C. 154(b) by 0 days.

(21) Appl. No.: 09/445,436

(22) PCT Filed: Jun. 4, 1998

(86) PCT No.: PCT/NZ98/00075

§ 371 (c)(1),
(2), (4) Date: Mar. 14, 2000

(87) PCT Pub. No.: WO98/56507

PCT Pub. Date: Dec. 17, 1998

(30) Foreign Application Priority Data

Jun. 11, 1997 (NZ) ..... 328061

(51) Int. Cl.[7] ..... B02C 19/00
(52) U.S. Cl. ..... 241/275; 241/5
(58) Field of Search ..... 241/275, 5

(56) References Cited

U.S. PATENT DOCUMENTS

| | | | | |
|---|---|---|---|---|
| 2,992,783 A | | 7/1961 | Wirth et al. | 241/275 |
| 3,970,257 A | * | 7/1976 | MacDonald et al. | 241/275 |
| 4,090,673 A | * | 5/1978 | Ackers et al. | 241/275 |
| 4,106,707 A | * | 8/1978 | Kemnitz | 241/202 |
| 4,326,676 A | * | 4/1982 | Rose | 241/275 |

(List continued on next page.)

FOREIGN PATENT DOCUMENTS

| | | |
|---|---|---|
| AU | 463819 | 4/1975 |
| AU | 557168 | 12/1986 |
| AU | 562251 | 10/1987 |
| AU | 36804/97 | 3/1998 |
| EP | 0101277 | 2/1984 |

(List continued on next page.)

*Primary Examiner*—Allen Ostrager
*Assistant Examiner*—William Hong
(74) *Attorney, Agent, or Firm*—Jacobson Holman, PLLC

(57) ABSTRACT

In a rotary mineral crusher a method of either localising the wear on a weir tip (1) in the crusher and/or focusing the output of the rotor (7) into its interaction chamber and/or reducing mineral erosion of the exterior of the rotor (7) by mineral piece particles energised by the output from the rotor (7). The rotary mineral crusher is of a kind having a rotor (7) into which the mineral pieces to be reduced in size, that is crushed, are fed from above and least substantially axially over the axis of rotation of the rotor (7) to thereafter migrate on an acceleration locus or loci of migration there retained bed or retained beds of mineral pieces from the rotor (7) substantially radially of the rotor (7) into the surrounding interaction chamber capable of retaining the lining of the mineral material. The method comprises or includes retaining the, or each, rotor (7) retained bed of mineral pieces with weir-like means defining a sacrificial edge or weir tip (1) over at least substantially the traverse extend of a migration locus at each edge. The sacrificial edge is of the form which allows an enhanced flow of mineral pieces over a preferred region of the sacrificial edge without reliance for such enhanced outflow (2), on a symmetric "V" or "U" or scallop. The means to retain the lining of mineral pieces of the surrounding interaction chamber is also configured so as to provide a preference for interaction of mineral pieces in a zone of the surrounding chamber adequately lined with such mineral pieces. Optionally, there is also provided shielding means (5, 6) to at least substantially confine the mineral pieces of the interaction zone from the rotor (7), save over the enhanced outflow (2) focus, and thereof at least towards the retained lining of the mineral pieces of the interaction chamber.

9 Claims, 6 Drawing Sheets

U.S. PATENT DOCUMENTS

| | | | | | |
|---|---|---|---|---|---|
| 4,436,138 | A | * | 3/1984 | Kondo | 164/5 |
| 4,575,013 | A | * | 3/1986 | Bartley | 241/275 |
| 4,662,571 | A | * | 5/1987 | MacDonald et al. | 241/81 |
| 4,844,354 | A | * | 7/1989 | Watajima | 241/162 |
| 4,844,364 | A | * | 7/1989 | Rossouw et al. | 241/275 |
| 4,921,173 | A | * | 5/1990 | Bartley | 241/5 |
| 4,940,188 | A | | 7/1990 | Rodriguez et al. | 241/275 |
| 5,135,177 | A | * | 8/1992 | Okuhara | 241/275 |
| 5,184,784 | A | * | 2/1993 | Rose et al. | 241/275 |
| 5,791,571 | A | * | 8/1998 | Hijikata | 241/188.2 |

FOREIGN PATENT DOCUMENTS

| | | |
|---|---|---|
| NZ | 198307 | 4/1986 |
| NZ | 201190 | 7/1986 |
| NZ | 201418 | 8/1986 |
| NZ | 213510 | 2/1989 |
| NZ | 217753 | 2/1989 |
| NZ | 217752 | 12/1990 |
| NZ | 229518 | 6/1991 |
| NZ | 250027 | 10/1996 |
| NZ | 299518 | 3/1999 |
| WO | WO95/10358 | 4/1995 |
| WO | WO95/10359 | 4/1995 |
| WO | WO95/11086 | 4/1995 |

* cited by examiner

ROTOR FLOW MATCHING TO MINERAL BREAKING CHAMBER

TECHNICAL FIELD

The present invention relates to improvements in and/or relating to mineral breakers.

BACKGROUND OF THE INVENTION

Our mineral breaker was first disclosed in Australian Patent Specification No. 463819. Such a mineral breaker was revolutionary at the time since it embodied a system whereby a plurality of the mineral beds are defined within a rotating element (rotor) thus ensuring the majority of the wear (save for a hardened wear tip) is of mineral against mineral.

Enhancements of the original machine are disclosed in our U.S. Pat. No. 4,662,571 (NZ198307), U.S. Pat. No. 4,586,663 (EPO 101277 and NZ201190), U.S. Pat. No. 4,575,013, (NZ 201418), U.S. Pat. No. 4,921,173 (NZ213510), and WO 95/11086 (NZ 250027).

Our U.S. Pat. No. 4,586,663 discloses an improvement whereby, as an enhancement, a hardened wear tip blade is mounted within a recess at the edge of a carrier which is to be positioned at a position where, in the manner of a weir, the smaller pieces of mineral overflow to exit the device.

U.S. Pat. No. 2992783 (Wirth et al) also show a mineral breaker of a kind having a substantially vertical axis feed into a rotor.

U.S. Pat. No. 4940188 of J Rodriguez and D Rodriguez discloses yet a further refinement of the system. This U.S. Patent discloses the use of a weir member which acts substantially as a straight edged wear tip but which better manages the weir erosion.

New Zealand Patent Specification 248953 (WO 95/10358) Tidco International Limited discloses yet a further refinement of the weir tip aspects.

In our WO 95/11086 there is disclosed and claimed a variety of tip defining assemblies for inclusion in a rotor of such a mineral breaker, the weir-like edge being configured, assembled or otherwise arranged to provide a region of flow enhancement such that a greater depth of mineral pieces passes over that edge region favoured to be eroded and to retain a bed of material having a transverse surface conforming to the weir-like edge. Symmetric contours for such a weir-like edge are defined with the preferred forms being to a V, U or other scalloped configuration.

Attention is also drawn to our U.S. Pat. No. 5,911,370 and to our patent specification WO98/56508.

The present invention is therefore directed to providing at least one of a number of possible advantages through localising or focusing the radial high energy streams from the rotor in a rotary mineral crusher where such output high energy materials are to impact mineral pieces within a surrounding crushing chamber. Preferably such a chamber is lined with a lining or bed of mineral pieces (irrespective of whether or not there is a secondary or by-pass flow of other pieces into such a chamber that by-passes the rotor) and from which chamber there is an exit for at least one stream of material of reduced average particle size to that of the original infeed material into the rotor and/or by-passing the rotor into the crushing chamber.

BRIEF SUMMARY OF THE INVENTION

Accordingly in a first aspect the invention consists, in a rotary mineral crusher, a method of any one or more of (i) localising wear on a wear tip in the crusher, (ii) focusing the output of the rotor into its interaction chamber, and (iii) reducing mineral erosion of the exterior of the rotor by mineral particles energised by the output from the rotor, said rotary mineral crusher being of a kind having a rotor into which mineral pieces to be reduced in size (ie: "crushed") is fed from above and at least substantially axially of the axis of rotation of the rotor to thence migrate on an acceleration locus or loci of migration via a retained bed or retained beds of mineral pieces from the rotor substantially radially of the rotor into a surrounding interaction chamber capable of retaining a lining of the mineral material, said method comprising or including retaining the or each rotor retained bed of mineral pieces with weir-like means defining a sacrificial edge (the "wear tip") over at least substantially the transversal extent of the migration locus at each such edge, said sacrificial edge being of a form which allows an enhanced outflow of mineral pieces over a preferred region of the sacrificial edge without reliance for such enhanced outflow on a symmetric "V", "U", or scallop form, and configuring the means to retain the lining of mineral pieces of the surrounding interaction chamber so as to provide a preference for interactions of mineral pieces in a zone of the surrounding chamber adequately lined with such mineral pieces, and optionally, providing shielding means to at least substantially confine the mineral pieces of the interaction zone from the rotor save over the enhanced outflow focused band(s) thereof at least towards the retained lining of mineral pieces of said surrounding interaction chamber.

Preferably there is the additional step of providing interaction zone confinement means (eg: shielding means) to reduce the opening available for the outflow stream of mineral pieces to enter into the surrounding interaction chamber with its retained mineral piece lining.

Preferably said interaction zone confinement means are stationary.

Preferably said interaction zone confinement means is or are in addition to said shielding means.

Preferably said shielding means is or are stationary.

In a further aspect the present invention consists in a rotary mineral crusher modified so as to perform inevitably a method as previously set forth.

In still a further aspect the present invention consists in, in a rotary mineral crusher, the provision of a rotor in to which mineral to be crushed is fed at least substantially axially of the substantially horizontally rotating rotor to thence migrate on an acceleration locus (or loci) of migration via a weir-like member/assembly retained bed of mineral pieces (or a plurality thereof) to flow from the rotor substantially radially of the rotor, and a surrounding interaction zone defined by static means capable of retaining a lining of mineral pieces, the construction and arrangement being such that each said weir-like member/assembly provides other than with a simple vertical sacrificial (preferably hardened edge) over the fall transverse extent of said migration locus at such edge means (not a symmetric "v", "u" or scallop form but can be a straight edge that is not vertical or parallel to the rotor axis) which enhances the outflow of mineral pieces over one specific region of such edge or several specific regions of the edge.

Preferably said lining of mineral pieces are confined by means, top and/or bottom, to reduce the opening to the lining for the outflow stream of mineral pieces.

Preferably there is shielding means between said rotor and the lining to at least reduce contact of the rotor by mineral pieces once they have entered the interaction zone.

Preferably the arrangement is as depicted in any one of the following drawings. Preferably said weir-like member/assemblies are in any of the form insofar as type, material, or mounting is concerned as defined in any one of the earlier mentioned patent specifications but which are asymmetric in the form of the edge when viewed as it will be positioned into the locus of migration eg; half a v, half a u or some other scallop form (eg; a step form).

As used herein throughout the terms "crushing", "mineral", are to be construed broadly. "Mineral" includes within its scope any material capable upon mutual collision with like materials of disintegrating into smaller pieces. "Crushing" clearly embodies other than crushing under sheer weight. "Crushing" is used to describe size reduction as a result of single or multiple interactions between different pieces of the material.

In a further aspect the present invention consists in a method as previously defined comprising the additional step of providing means to reduce the opening available for the outflow stream of mineral pieces to enter, (e.g. preferably one or two lips) into the crushing chamber with its retained mineral piece lining.

In addition preferably there is the step (by providing a shroud or shield that remains during use in fixed relationship with the means that retains the lining) of minimising the effect of rebounding mineral pieces or deflected mineral pieces on the exterior of the rotor at least on those surfaces thereof above and below any at least one circumferential or peripheral port defined adjacent or in part by said weir-like member(s)/assembly(s).

In still a further aspect the present invention consists in apparatus and/or method(s) substantially as herein described with reference to any one or more of the accompanying drawings.

In a further aspect the present invention consists in a tip defining component or assembly for inclusion in a rotor of a mineral breaker, said tip being engageable directly to or via a holder to the rotor to define a weir-like edge that extends substantially transversely of the direction from which mineral pieces in use are to overflow from a retained bed thereof, said edge being characterised in that it is configured, assembled or otherwise arranged to provide a region of flow enhancement such that a concentrated stream of mineral pieces passes preferentially over that part of the edge region, said weir-like edge not being symmetric in that transverse view.

Preferably the top defining component or assembly is of any of the kinds generally as described in any one of the aforementioned patent specifications but which includes therein a change configuration to at least the primary wear tip thereof so as to provide by its asymmetry the desired concentration or focusing of the stream.

The present invention also consists in the use of apparatus of the present invention.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

Preferred forms of the present invention will now be described with reference to the accompanying drawings in which.

DETAILED DESCRIPTION

Figure 1:
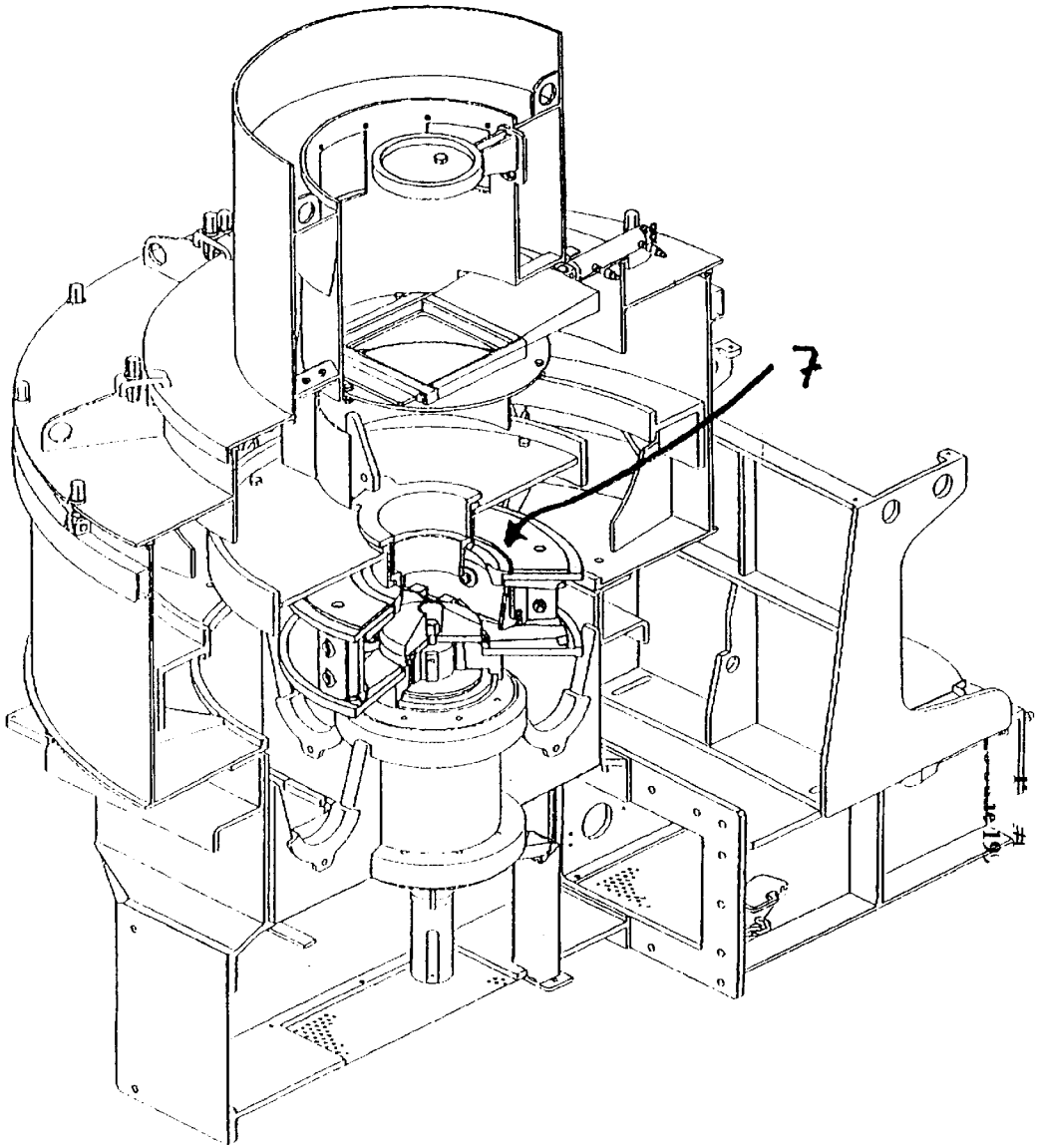
FIG. 1 is a perspective view of apparatus typical of that marketed by this company as a rotary mineral crusher under the BARMAC™ trade mark.

The description of the present invention will be described by way of example only in respect of a BARMAC™ machine of a kind as depicted in FIG. 1. Any of the prior art or other forms of such rotary mineral crusher lend themselves to the incorporation of the apparatus, methods and procedures of the present invention.

Figure 7:
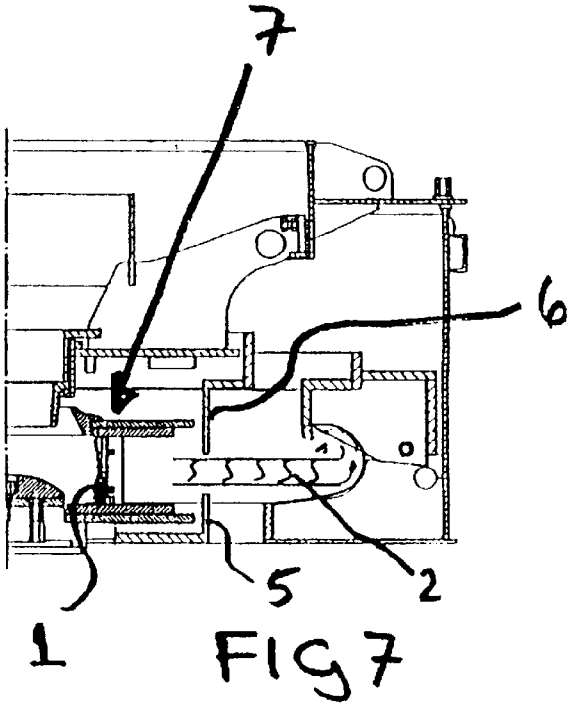
FIG. 7 is a similar view to that of FIG. 6 but shown how such a focused flow path from the rotor allows rotor shields to extend both downwardly and upwardly to prevent mineral pieces in the interaction zone from easily impacting back against erodible metal regions of the high speed rotor, such shields preferably being stationary.
Figure 6:
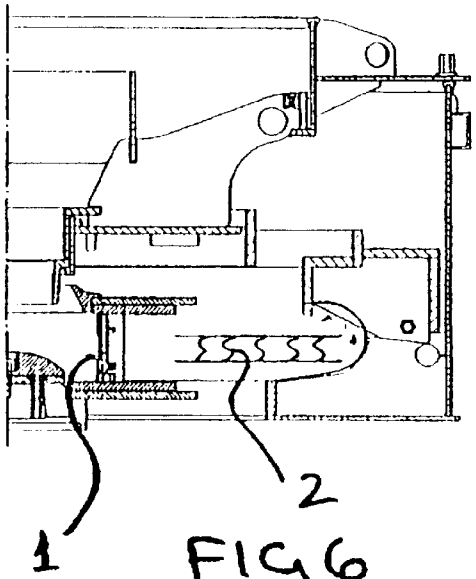
FIG. 6 is a similar view to that of FIG. 5 but showing the more focused and narrow in extend outflow of mineral pieces from the rotor where a "V" tip of a kind as disclosed in (by way of example our PCT/NZ94/00111 (WO95/11086) patent specification)
Figure 6A:
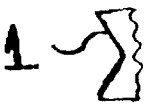
FIG. 6A shows the preferred "V" configuration of such a wear-tip.
Figure 5:
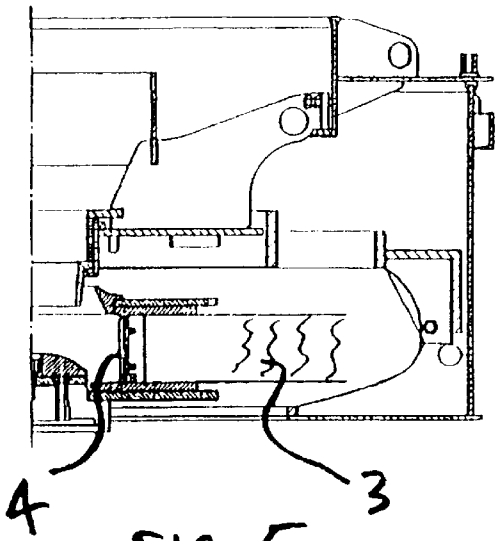
FIG. 5 is a similar view to that of FIG. 2 but showing a flow path for rotor flung mineral pieces into the interaction zone where the wear-like edge is vertical, i.e. the mineral that flung outwardly from each outlet port of the rotor over the full depth of the rotor.
Figure 5A:
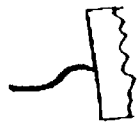
FIG. 5A shows the straight edge preferably a sacrificial hardened edge, e.g. with carbide of the wear-tip assembly, typically used in such apparatus.

The present invention recognises that by appropriate use of a focusing wear-tip 1 (see FIG. 6, 6A and FIG. 7)—preferably a substantially symmetric "V"—a focused outflow 2 occurs as opposed to the non-focused outflow 3 (see FIG. 5) which occurs when a straight vertical edge 4 for a wear-tip is utilised. This therefore allows the utilisation of stationary upwardly extending shields 5 and downwardly extending shields 6 to protect the rotor 7.

Figure 8:
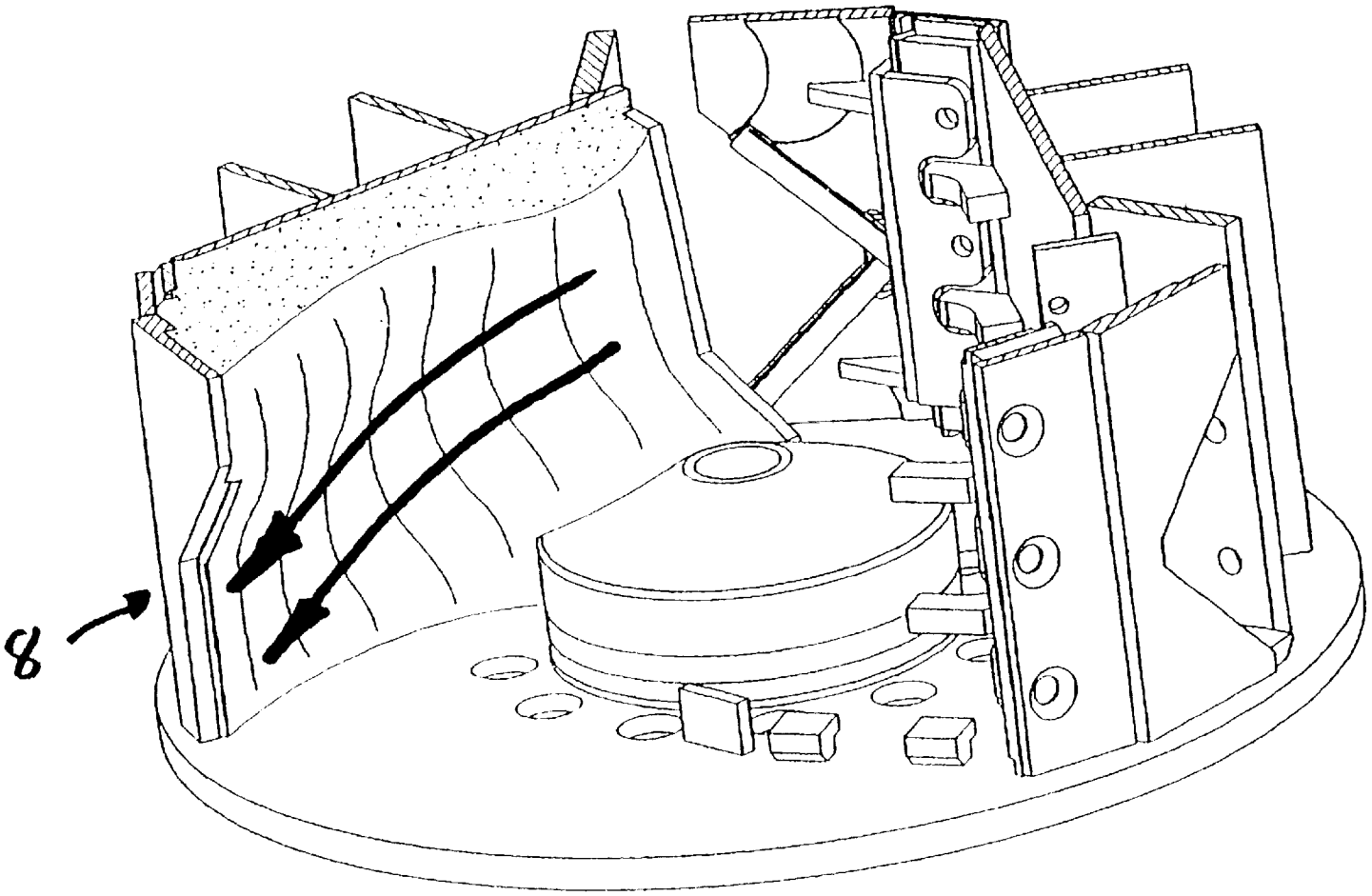
FIG. 8 shows a retained bed of preferred form, the geometries at the weir-like edge and the trailing geometry being such as to tune the retained bed(s) of the rotor to encourage a sweeping downward curving flow over the retained bed so as to exit at a "focused" region that has been focused between a bottom plate (which itself may be optionally protected) or which may be protected by some measure of enhanced bed retention at lower edges by using an asymmetric "V" wear-tip and which can if desired include a step down plate or other rotor element or elements so as facilitate a greater sweep without too much rotor depth.
Figure 9:
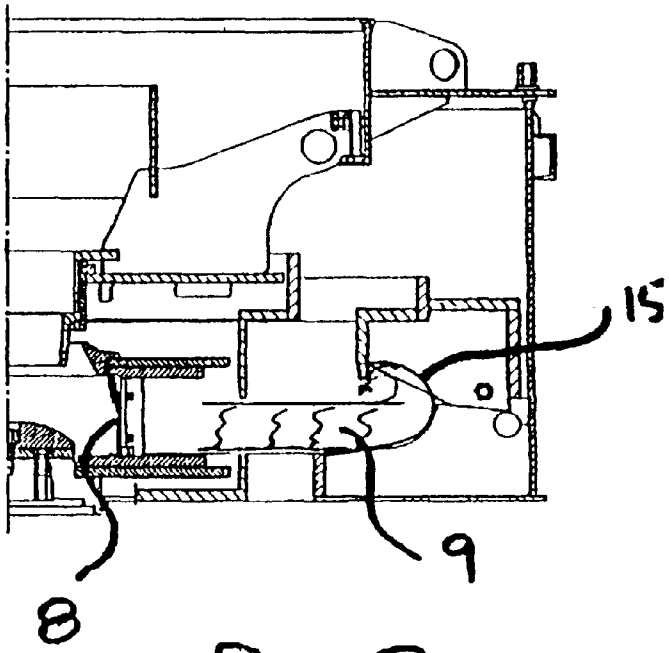
FIG. 9 is a similar view to that of FIG. 7 but showing how the tuned bed and asymmetric wear-tip of FIG. 8 modifies the focus of the flow but still enables the use of a downwardly extending stationary shroud or shield for the rotor.
Figure 9A:
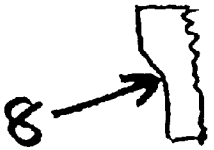
FIG. 9A shows in a manner similar to that of FIGS. 5A and 6A the preferred asymmetric edge of the wear-tip.

In alternative forms such as those disclosed by reference to FIG. 8 , asymmetric wear-tip forms such as shown in FIGS. 9 and 9A lend themselves to a differently focused outflow path 9.

Figure 2:
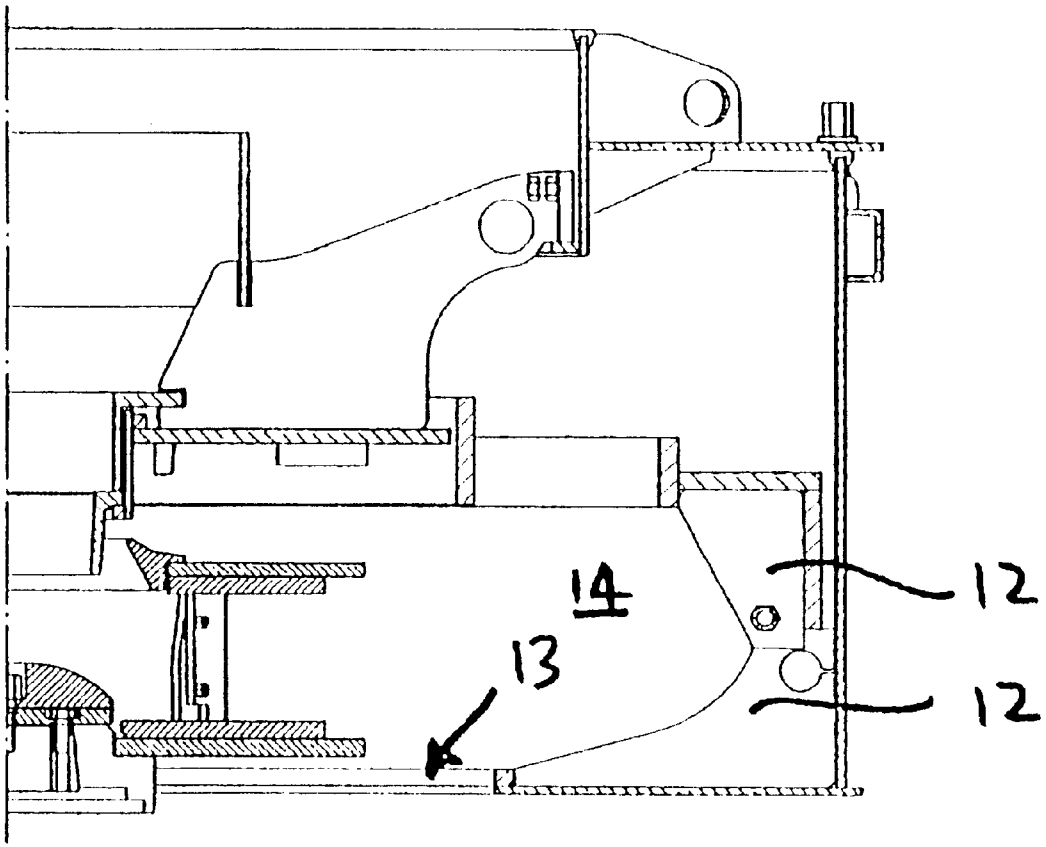
FIG. 2 is an elevational cross-section of part of the assembly as shown in FIG. 1 showing how the extremity of the rotor and its outlet port for material accelerated into an outward radial flow (from its original gravity assisted axial feed into the rotor) is flung into a reaction chamber or zone (the crushing chamber) which is to define a stationary bed for containing the mineral piece interactions as well as for providing a surface for impacting prior to cascading of broken pieces downwardly from the chamber.
Figure 4:
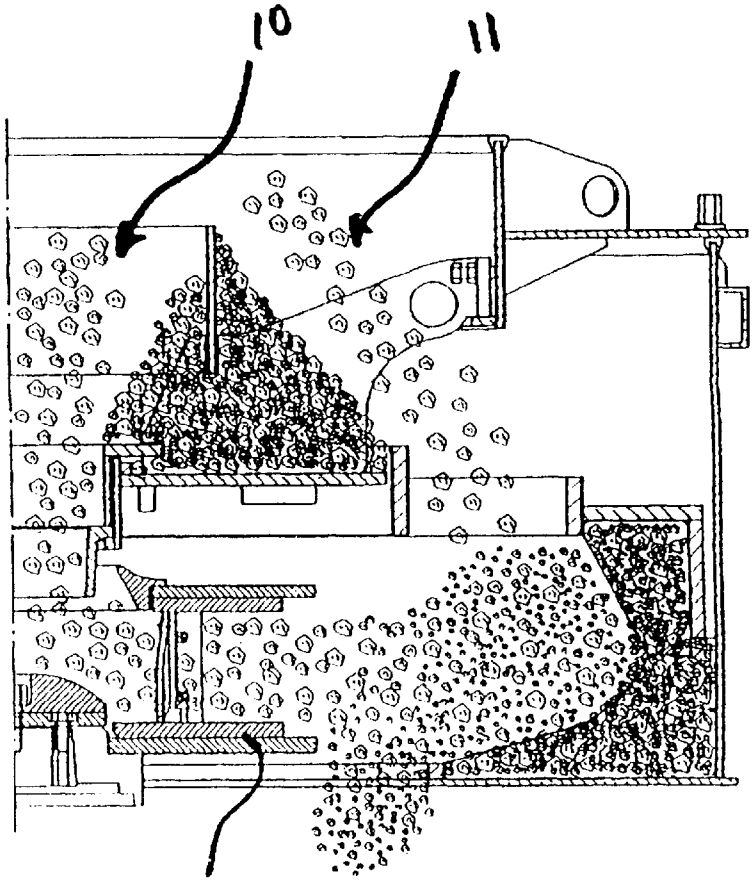
FIG. 4 is a similar view to that of FIG. 3 but showing the greater number of interactions that occurs when some of the in feed of mineral pieces is diverted to bypass the rotor and enters directly into the reaction or interaction chamber, the downward outlet from the interaction chamber being shown by reference to the downwardly moving broken down pieces.
Figure 3:
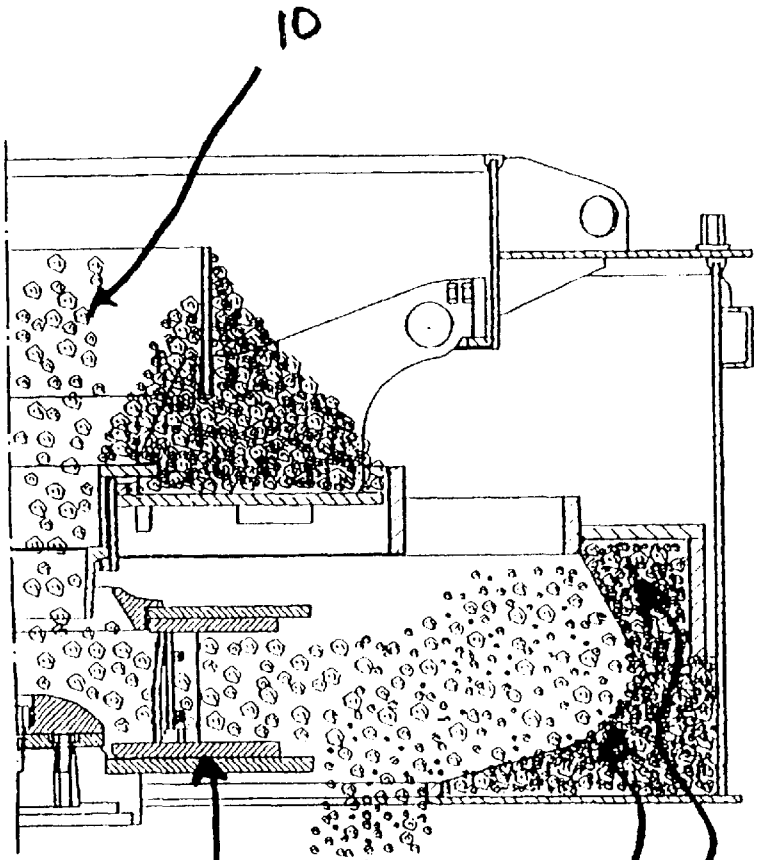
FIG. 3 shows the normal mode of operation by reference to the stationary bed of the reaction chamber and the material outflow when the apparatus typified by that of FIG. 1 is being operated with a single feed, i.e. the axial feed down into the rotor.

The rotor 7 outwardly flings material pieces as shown in FIGS. 3 and 4 which are the primary axial feed mineral pieces. When the apparatus is being operated in the by-pass dual flow mode (as shown in FIG. 2) an outward by-pass flow of, for example, 10% of the overall mineral piece flow enhances interactions, this by-pass flow 11 (as depicted in FIG. 4) greatly increasing the number of pieces in the interaction zone or crushing chamber.

The focused stream and matching tighter crushing chamber made possible is to make greater usage oft he kinetic energy of the outwardly accelerated pieces from the rotor 7.

In FIGS. 1 and 2 stationary members 12 hold a stationary receptor bed of mineral pieces accessible by the energised mineral pieces only via the annular outlet 13 into the interaction chamber 14. These members 12 define a retained bed as shown as 15 in FIG. 3 and in FIG. 9.

As depicted (eg; see FIG. 5) the exiting material is much narrower and more dense in its energised outflow. This enables the use of a tighter crushing chamber for more efficient crushing.

The narrower exit path also lends itself to the use of the rotor shields (such as 5 and 6) depicted.

The preferred embodiment shown enables (i) a reduction in input energy to achieve the same number of mineral breaking interactions, (ii) a reduction in wear from decelerated or rebounding mineral pieces or chips on the rotor, and (iii) more localised wear only on sacrificial (yet hardened) regions of the wear tops which preferably are easily changeable.

What we claim is:

1. A method for at least one of (i) localising wear on a wear tip in a rotary mineral crusher, (ii) focusing output of a rotor of the rotary mineral crusher into an interaction chamber, and (iii) reducing mineral erosion of an exterior of the rotor by mineral particles energised by the output from the rotor of the rotary mineral crusher, said method comprising the step of:

providing a rotary mineral crusher having a rotor into which mineral pieces to be reduced in size are fed from above and at least substantially axially of an axis of rotation of the rotor to thence migrate on at least one acceleration locus of migration via at least one retained bed of mineral pieces from the rotor substantially radially of the rotor into a surrounding interaction chamber capable of retaining a lining of the mineral material, retaining the at least one rotor retained bed of mineral pieces by a respective sacrificial edge of a wear tip over at least substantially a transversal extent of the at least one migration locus at each said sacrificial edge, said sacrificial edge being of an asymmetric form which allows an enhanced outflow of mineral pieces over a preferred region of the sacrificial edge without reliance for such enhanced outflow on one of a symmetric "V", "U", and scallop form, configuring the lining of mineral pieces of the surrounding interaction chamber so as to provide a preference for interactions of mineral pieces in a zone of the surrounding interaction chamber adequately lined with mineral pieces, and providing shielding to at least substantially confine the mineral pieces from the rotor save over at least one enhanced outflow focused band thereof at least towards the retained lining of mineral pieces of said surrounding interaction chamber.

2. The method of claim 1, further providing an interaction zone confinement means to reduce an opening available for an outflow stream of mineral pieces to the retained mineral piece lining of the surrounding interaction chamber.

3. The method of claim 2, wherein said interaction zone confinement means are stationary.

4. The method of claim 2, wherein said interaction zone confinement means is in addition to said shielding.

5. The method of claim 4, wherein said shielding is stationary.

6. A rotary mineral crusher comprising:

a substantially horizontally rotating rotor in to which mineral to be crushed is fed at least substantially axially of the substantially horizontally rotating rotor to thence migrate on at least one acceleration locus of migration via at least one retained bed of mineral pieces to flow from the rotor substantially radially of the rotor, and a surrounding mineral piece interaction zone defined by static means for retaining a lining of mineral pieces, the construction and arrangement of the at least one bed of mineral pieces being other than with a simple vertical sacrificial edge at least substantially over a full transverse extent of said at least one migration locus at such an edge means other than one of a symmetric "V", "U" and scallop form but being a straight edge that is other than one of vertical and parallel to the rotor axis which enhances outflow of mineral pieces over at least one specific region of said edge means.

7. The crusher of claim 6, wherein said lining of mineral pieces are confined by means to reduce an opening to the lining for the outflow stream of mineral pieces.

8. The crusher of claim 6, wherein shielding means between said rotor and the lining at least reduce contact of the rotor by mineral pieces once the mineral pieces have entered the interaction zone.

9. A component for inclusion in a rotor of a mineral breaker, said component comprising:

a tip engageable with the rotor to define an edge extending substantially transversely of a direction from which mineral pieces in use are to overflow from a retained bed thereof, said edge being one of configured, assembled and arranged to provide a region of flow enhancement such that a concentrated stream of mineral pieces passes over a part of a region of said edge, said edge being asymmetric in a transverse view.

* * * * *